US005881658A

United States Patent [19]

Nozaki et al.

[11] Patent Number: 5,881,658

[45] Date of Patent: Mar. 16, 1999

[54] OSCILLATING SHUTTLE OF SEWING MACHINE

[75] Inventors: Yoshihisa Nozaki, Aichi; Motonari Nakano, Ichinomiya; Koichi Harada, Komaki; Koichi Akahane, Nagoya; Takashi Kondo, Ohbu; Akira Nishio, Aichi, all of Japan

[73] Assignee: Brother Kogyo Kabushiki Kaisha, Nagota, Japan

[21] Appl. No.: 82,467

[22] Filed: May 21, 1998

[30] Foreign Application Priority Data

Jun. 2, 1997 [JP] Japan ..... 9-160443

[51] Int. Cl.[6] ..... D05B 57/12

[52] U.S. Cl. ..... 112/192; 112/232

[58] Field of Search ..... 112/192, 193, 112/187, 232, 184

[56] References Cited

U.S. PATENT DOCUMENTS 3,006,298 10/1961 Johnson ..... 112/192

4,724,782 2/1988 Reber ..... 112/192

*Primary Examiner*—Peter Nerbun

*Attorney, Agent, or Firm*—Oliff & Berridge, PLC

[57] ABSTRACT

An oscillating shuttle, including a shuttle race having a substantially annular guide groove including two end portions opposed to each other in a circumferential direction thereof, a shuttle body which includes a part-annular guided portion and a hook portion and which is oscillatory while the guided portion is guided by the guide groove, a driver which rotates the shuttle body about an axis line, wherein when the hook portion hooks a thread loop, the shuttle body is rotated by the driver in one of opposite directions such that the tail portion passes through one of the two end portions of the guide groove and enters an upper opening of the shuttle race and, when the shuttle body is rotated back in the other direction, a tail portion of the guided portion enters the one end portion of the guide groove, and at least one of the one end portion of the guide groove which has, in a direction parallel to the axis line, a width greater than a width of a remaining portion of the guide groove, and the tail portion of the guided portion which has, in a direction parallel to the axis line, a width smaller than a width of a remaining portion of the guided portion.

9 Claims, 7 Drawing Sheets

OSCILLATING SHUTTLE OF SEWING MACHINE

BACKGROUND OF THE INVENTION

1. Field of the Invention

The present invention generally relates to an oscillating shuttle of a sewing machine and relates particularly to the art of preventing a needle-thread loop from being bitten by the oscillating shuttle.

2. Related Art Statement

There is known a lock-stitch sewing machine which employs, as a thread-loop catcher including a hook portion for hooking or catching a loop of a needle thread conveyed by the eye of a sewing needle, and locking the needle-thread loop with a bobbin thread, a rotary hook which is fully rotatable at a high speed. There is also known a twin-needle sewing machine which employs, for performing bar-tack stitching on thick work sheets, two oscillating shuttles each of which has a driver which drives a shuttle body and includes a needle guard for preventing a corresponding sewing needle from being excessively moved toward the shuttle during its sewing operation. Since, in an oscillating shuttle, a loop of a needle thread is released from a hook portion at an early timing, the needle thread is easily drawn up and the needle-thread loop is well tightened. An oscillating shuttle includes a first shuttle race member which is attached to a bed of a sewing machine such that the first race member takes a horizontal attitude; a second shuttle race member which is detachably attached to the first race member to provide a shuttle race; a shuttle body which is accommodated in an inner space of the shuttle race; and a driver which drives or half-rotates the shuttle body in opposite directions.

FIG. 10 shows a known oscillating shuttle 100 which includes a first shuttle race member 102; a second shuttle race member 103 which is detachably attached to the first race member 102 to provide a shuttle race having a substantially annular guide groove 107 at an interface where the second race member 103 is attached to the first race member 102; a shuttle body 104 which has a generally semi-circular shape as viewed from its front side and which includes a generally semi-annular guided portion 104*b* which is provided over a substantially entire outer surface thereof and which has a generally rectangular cross section; and a driver (not shown) which half-rotates the shuttle body 104 in opposite directions in synchronism with upward and downward movements of a sewing needle 111, while the guided portion 104*b* is slideably guided by the guide groove 107.

The known oscillating shuttle 100 is operated such that, when the sewing needle 111 is moved up by a small distance from its lowest position, the needle thread 112 conveyed by the eye of the needle 111 is hooked or caught by a hook portion 104*a* of the shuttle body 104 being rotated in a forward direction and, when the shuttle body 104 is generally half rotated in the forward direction, a widened loop 112*a* slips from the hook portion 104*a*. Then, as the shuttle body 104 is rotated in a backward direction opposite to the forward direction, and as a needle-thread take-up is substantially simultaneously moved up, the needle-thread loop 112*a* is tightened up while being locked with a bobbin thread supplied from a bobbin (not shown) accommodated in a bobbin case (not shown) supported by the shuttle body 104. The needle-thread loop 112*a* is passed between the driver and a rear end portion of the shuttle body 104 opposite to the hook portion 104*a*, and is drawn up through a throat plate 110, so that a lock stitch is formed on thick work sheets W1, W2.

In the case where the known oscillating shuttle 100 is used for sewing, using a thick needle thread, the plurality of thick work sheets W1, W2 (e.g., denim sheets) superposed on each other, the shuttle body 104 starts its reverse rotation at a timing at which the needle-thread loop 112*a* widened by the hook portion 104*a* slips from the same 14*a*. Substantially simultaneously, the needle-thread take-up starts its upward movement and accordingly the needle-thread loop is tightened. However, since the superposed thick work sheets W1, W2 exert a great resistance to the needle thread 112 being moved therethrough, the needle-thread take-up may fail to draw up a sufficient length of the needle thread 112. That is, as shown in FIG. 10, a lower end portion of the needle-thread loop 112*a* may be caught by a tail portion of the shuttle body 104 because the tightening of the loop 112 delays when the tail portion of the shuttle body 104 is moved back through an upper opening formed in respective upper end portions of the first and second race members 102, 103.

Thus, the lower end portion of the needle-thread loop 112*a* is forced to enter the spaces defined by opposite surfaces of the guided portion 104*b* of the shuttle body 104 and opposed surfaces of the first and second race members 102, 103 which cooperate with each other to define the guide groove 107. Since those spaces are very narrow, the loop 112*a* is bitten fast, and breaks.

SUMMARY OF THE INVENTION

It is therefore an object of the present invention to provide an oscillating shuttle of a sewing machine which can prevent a needle-thread loop from being bitten by a guided portion of a shuttle body and a guide groove of a shuttle race.

The present invention provides an oscillating shuttle which has one or more of the technical features which are described below in respective paragraphs given parenthesized sequential numbers (1) to (9). Any technical feature which includes another technical feature shall do so by referring, at the beginning, to the parenthesized sequential number given to that technical feature. Thus, two or more of the following technical features may be combined, if appropriate. Each technical feature may be accompanied by a supplemental explanation, as needed.

(1) According to a first feature of the present invention, there is provided an oscillating shuttle, comprising a first shuttle race member; a second shuttle race member which is attached to the first shuttle race member and which cooperates with the first shuttle race member to provide a shuttle race having a substantially annular guide groove in an inner surface thereof, the shuttle race having an upper opening through which a sewing needle and a needle thread conveyed by the needle pass, the guide groove including two end portions which open in the upper opening such that the two end portions are opposed to each other in a circumferential direction of the guide groove; a shuttle body which includes a part-annular guided portion and which is oscillateable while the part-annular guided portion is guided by the substantially annular guide groove, the shuttle body further including a hook portion which hooks a loop of the needle thread conveyed by the sewing needle, the part-annular guided portion including a tail portion which is opposite to the hook portion in the circumferential direction of the guide groove; a driver which rotates the shuttle body about an axis line, wherein when the hook portion of the shuttle body hooks the thread loop, the shuttle body is rotated by the driver in one of opposite directions such that the tail portion of the part-annular guided portion passes through one of the two end portions of the substantially annular guide groove and enters the upper opening of the shuttle race and, when the shuttle body is rotated back in the other direction, the tail portion of the guided portion enters the one end portion of the guide groove; and at least one of (a) the one end portion of the guide groove which has, in a direction parallel to the axis line, a width greater than a width of a remaining portion of the guide groove, and (b) the tail portion of the guided portion which has, in a direction parallel to the axis line, a width smaller than a width of a remaining portion of the guided portion. In the present oscillating shuttle, when the shuttle body has been rotated over a predetermined angle (e.g., about half rotation) in the one (i.e., forward) direction, the needle-thread loop widened by the hook portion slips from the hook portion. At this timing, the shuttle body starts its backward rotation and, substantially simultaneously, a needle-thread take-up starts its upward movement and accordingly the needle-thread loop is tightened. If work sheets to be sewn exert a great resistance to the needle thread being moved therethrough, the needle-thread take-up may fail to draw up a sufficient length of the needle thread. Thus, a lower end portion of the needle-thread loop may be caught by the tail portion of the guided portion of the shuttle body, because the tightening of the thread loop delays when the tail portion of the shuttle body is moved back through the upper opening of the shuttle race. That is, the lower end portion of the thread loop may be forced to enter spaces defined by opposite surfaces of the guided portion of the shuttle body, and opposed surfaces of the first and second race members which cooperate with each other to define the guide groove. More specifically described, a front portion of the lower end portion of the thread loop may be forced to enter a front space defined by a front surface of the guided portion and a rear surface of the second race member, and a rear portion of the lower end portion of the thread loop may be forced to enter a rear space defined by a rear surface of the guided portion and a front surface of the first race member, respectively. Each of the front and rear spaces is very small, for accurately positioning the hook portion relative to the sewing needle in the direction parallel to the axis line of rotation of the shuttle body. However, the possibility that the rear (or front) portion of the lower end portion of the thread loop may be forced to enter the rear space can be much lower than the possibility that the front (or rear) portion may be forced to enter the front space, owing to the provision of an appropriate needle and/or bobbin thread guide member. In addition, since the shuttle body can be supported by the driver such that the shuttle body is rotatable about the axis line, a sufficiently great space may be provided between an outer circumferential surface of the part-annular guided portion and an inner circumferential surface of the substantially annular guide groove. Moreover, the present oscillating shuttle has at least one of the first feature that the one end portion of the guide groove has, in the direction parallel to the axis line, a width greater than a width of the remaining portion of the guide groove, and the second feature that the tail portion of the guided portion has, in the direction parallel to the axis line, a width smaller than a width of the remaining portion of the guided portion. Thus, even if the lower end portion of the thread loop may be caught by the tail portion of the guided portion, the thread loop is not bitten or jammed and is easily passed through the thus widened front and/or rear spaces. Therefore, the biting or jamming of the needle thread is effectively prevented.

(2) According to a second feature of the present invention which includes the first feature (1), the tail portion of the guided portion has a pair of opposite surfaces which are opposite to each other in the direction parallel to the axis line, and the first and second shuttle race members have respective opposed surfaces which are opposed to each other in the direction parallel to the axis line and cooperate with each other to define the one end portion of the guide groove, wherein a first distance between one of the opposite surfaces of the tail portion and a corresponding one of the respective opposed surfaces of the first and second shuttle race members is different from a second distance between the other surface of the tail portion and the other surface of the respective opposed surfaces. The first distance may be smaller, or greater, than the second distance.

(3) According to a third feature of the present invention which includes the second feature (2), the second shuttle race member is detachably attachable to the first shuttle race member in the direction parallel to the axis line, and wherein the first distance between the one surface of the tail portion and the one surface of the first shuttle race member provided on the side of the driver is smaller than the second distance between the other surface of the tail portion and the other surface of the second shuttle race member. The first distance corresponds to the above-described rear space, and the second distance corresponds to the above-described front space.

(4) According to a fourth feature of the present invention which includes any one of the first to third features (1) to (3), the oscillating shuttle comprises the one end portion of the guide groove which has, in the direction parallel to the axis line, a width greater than a width of the remaining portion of the guide groove.

(5) According to a fifth feature of the present invention which includes the fourth feature (4), the first shuttle race member has a substantially cylindrical surface and a substantially annular surface, and the second shuttle race member has a substantially annular surface which cooperates with the substantially cylindrical surface and the substantially annular surface of the first shuttle race member to define the substantially annular guide groove.

(6) According to a sixth feature of the present invention which includes the fifth feature (5), the second shuttle race member has a recess in a portion thereof which defines a portion of the substantially annular surface thereof which corresponds to the one end portion of the guide groove, so that the width of the one end portion of the guide groove is greater, by a depth of the recess, than the width of the remaining portion of the guide groove. It is easier to form the recess in the second shuttle race member than in the first shuttle race member, because the recess can be easily formed by machining, for example, removing a portion of the substantially annular surface of the second race member.

(7) According to a seventh feature of the present invention which includes the sixth feature (6), the depth of the recess of the second shuttle race member in the direction parallel to the axis line is constant in the circumferential direction of the guide groove.

(8) According to an eighth feature of the present invention which includes the seventh feature (7), the constant depth of the recess of the second shuttle race member falls in a range of about 1.0 mm to about 1.5 mm.

(9) According to a ninth feature of the present invention which includes any one of the first to eighth features (1) to (8), the oscillating shuttle further comprises an attaching device which detachably attaches the second shuttle race member to the first shuttle race member in the direction parallel to the axis line.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
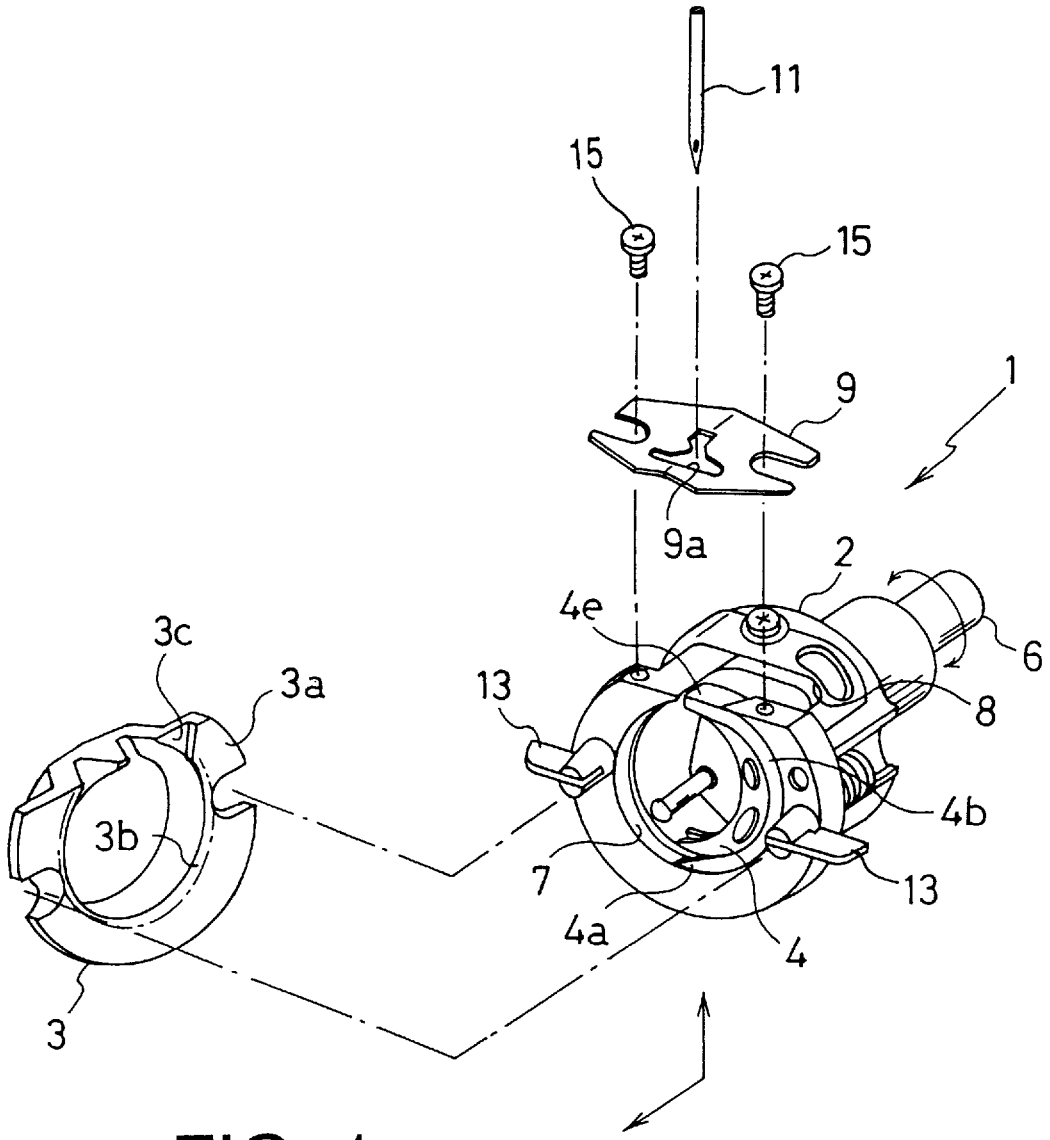
FIG. 1 is a perspective exploded view of an oscillating shuttle, employed in a sewing machine, to which the present invention is applied.
Figure 3:
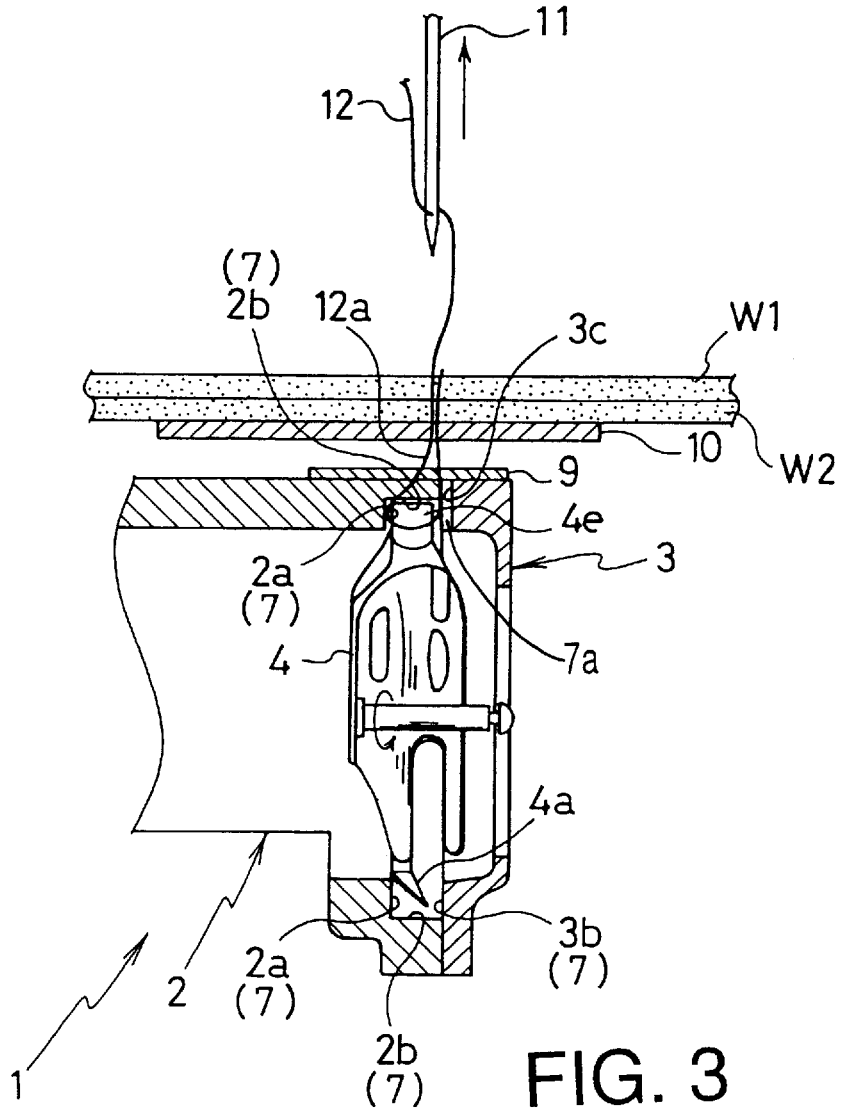
FIG. 3 is a cross-section view of the shuttle of FIG. 1 taken along line 3—3 in FIG. 2.

FIG. 1 shows an oscillating shuttle 1 which is provided in a bed (not shown) of a twin-needle sewing machine which is capable of performing a bar-tack stitching on work sheets W1, W2 (FIG. 3). The twin-needle sewing machine includes two sewing needles only one 11 of which is shown, and two oscillating shuttles only one 1 of which is shown. The two shuttles have an identical construction and accordingly the shuttle 1 will be described below as a representative of the two shuttles. The shuttle 1 includes a first shuttle race member 2 which is fixed to a frame member (not shown) of the bed such that the first race member 2 takes a horizontal attitude as shown in FIG. 3; a second shuttle race member 3 which has, a substantially annular shape and which is detachably attached, with the help of a pair of fastening members 13, to a front end surface of the first race member 2 to provide a shuttle race; a shuttle body 4 which is accommodated in an inner space of the first and second shuttle race members 2, 3; and a driver 5 which oscillates the shuttle body 4 by half-rotating the same 4 in opposite directions about a horizontal axis line. The driver 5 is half-rotated in opposite directions by a drive shaft 6 connected to a lower shaft (not shown) of the sewing machine, in synchronism with the reciprocation of the sewing needle 11 in a vertical direction.

As shown in FIGS. 1 and 3, the first and second shuttle race members 2, 3 cooperate with each other to define a substantially annular guide groove 7 at an interface where the second race member 3 is attached to the first race member 2. More specifically described, the substantially annular guide groove 7 is defined by a substantially annular front surface 2*a* and a substantially cylindrical bottom surface 2*b* of the first race member 2, and a substantially annular rear surface 3*b* of the second race member 3. The substantially annular front surface 2*a* and the substantially cylindrical bottom surface 2*b* of the first race member 2 cooperate with each other to define a substantially annular stepped groove which opens in the front end face of the first race member 2. The substantially annular rear surface 3*b* of the second race member 3 is provided by an inner peripheral portion of a contact surface 3*a* of the second race member 3, and has a predetermined width corresponding to a depth of the guide groove 7. The contact surface 3*a* contacts the front end surface of the first race member 2 when the second race member 3 is attached to the first race member 2.

The shuttle body 4 has a generally semi-circular shape as viewed from its front side. The shuttle body 4 has, in one of circumferentially opposite end portions thereof, a hook portion 4*a* which hooks a loop 12*a* of a needle thread 12 conveyed by an eye of the sewing needle 11. The shuttle body 4 also has a generally semi-annular guided portion 4*b* which circumferentially extends over a substantially entire outer surface thereof. The guided portion 4*b* has a rectangular cross section. The guided portion 4*b* is slideably engaged with the guide groove 7 and, when the shuttle body 4 is oscillated, i.e., half-rotated in the opposite directions by the driver 5, the guided portion 4*b* is also half-rotated in the opposite directions by being guided by the guide groove 7, in synchronism with the upward and downward reciprocation of the sewing needle 11, as shown in FIGS. 4 to 9.

Figure 6:
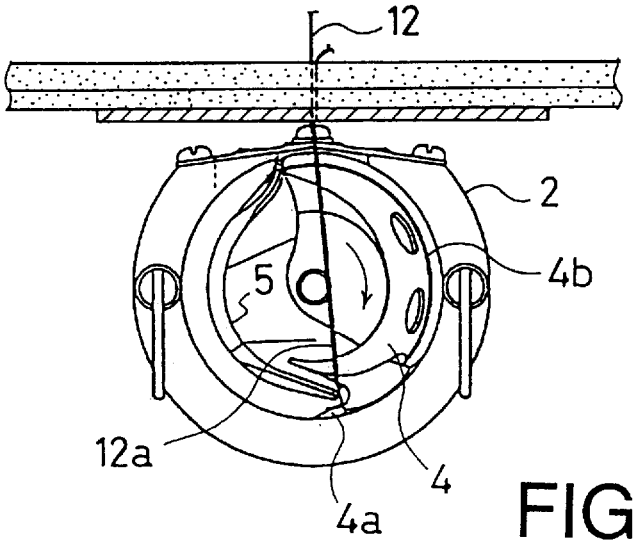
FIG. 6 is a view corresponding to FIG. 4, showing a state in which the needle-thread loop is about to slip from the hook portion.
Figure 7:
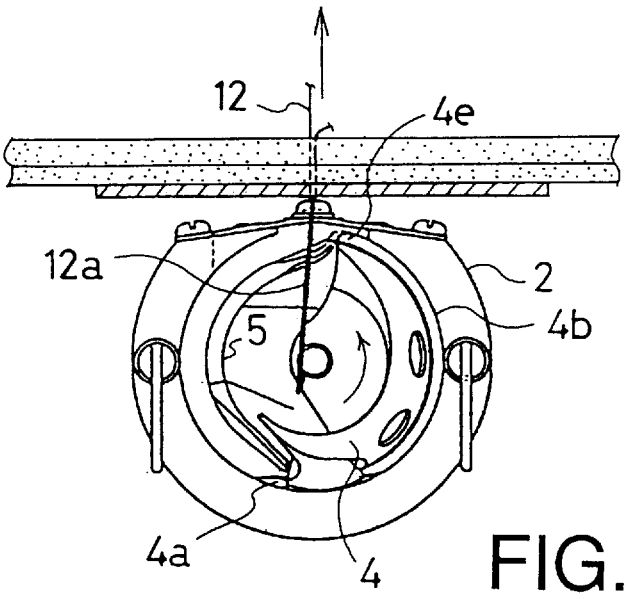
FIG. 7 is a view corresponding to FIG. 4, showing a state in which a shuttle body starts its reverse rotation.
Figure 8:
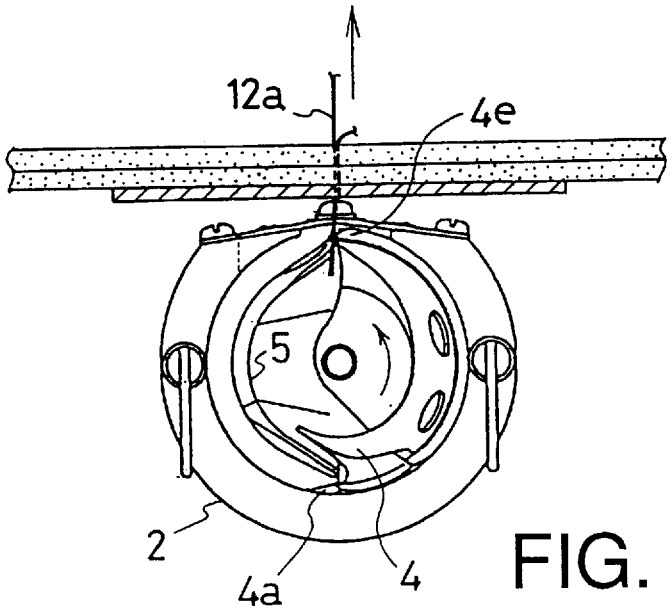
FIG. 8 is a view corresponding to FIG. 4, showing a state in which the needle-thread loop is about to pass over the shuttle body.
Figure 9:
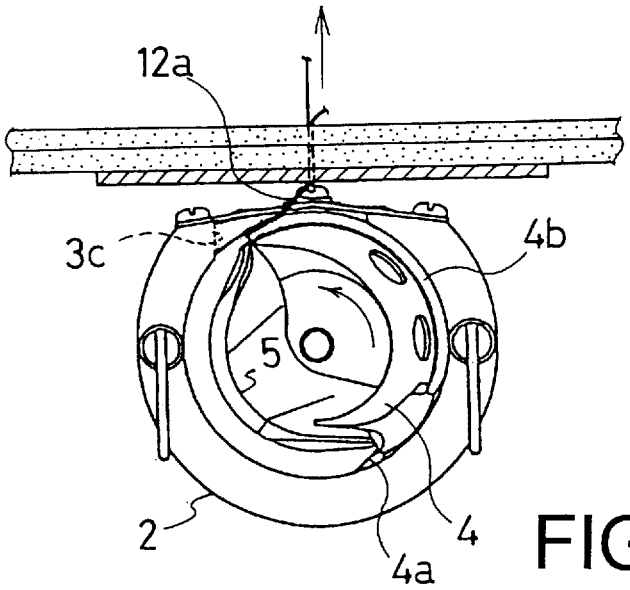
FIG. 9 is a view corresponding to FIG. 4, showing a state in which a lower end portion of the needle-thread loop is caught by a tail portion of a semi-annular guided portion of the shuttle body.
Figure 10:
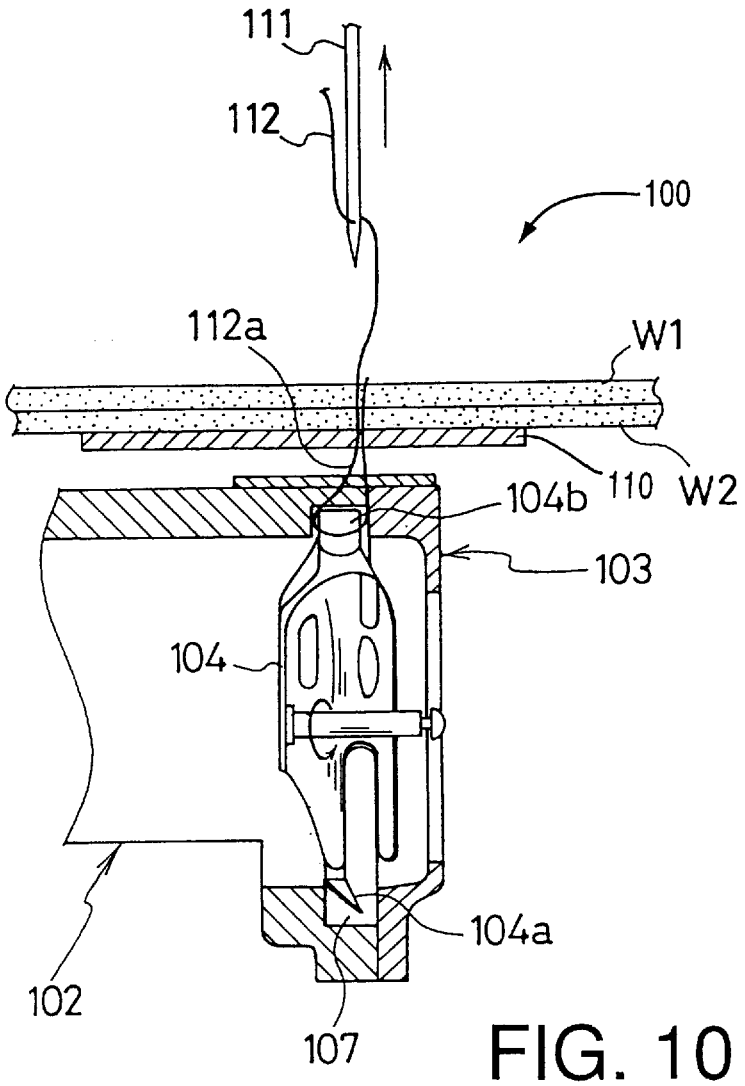
FIG. 10 PRIOR ART
FIG. 10 is a view corresponding to FIG. 3, showing a known oscillating shuttle.

The shuttle race provided by the first and second race members 2, 3 has, in an upper end portion thereof, an upper opening 8 through which the sewing needle 11 and the needle thread 12 pass. The substantially annular guide groove 7 is not continuous at the upper opening 8, and includes two end portions which open in the opening 8 such that the two end portions are opposed to each other in the circumferential direction of the guide groove 7. When the hook portion 4*a* hooks the thread loop 12*a*, the shuttle body 4 is rotated by the driver 5 in the clockwise direction in FIGS. 4 to 7 such that a tail portion 4*e* of the guided portion 4*b* which is circumferentially opposite to the hook portion 4*a* passes through one 7*a* of the two end portions of the guide groove 7 and enters the upper opening 8 of the shuttle race as shown in FIG. 7 and, when the shuttle body 4 is rotated back in the counterclockwise direction in FIGS. 7 to 9, the tail portion 4*e* of the guided portion 4*b* enters the one end portion 7*a* of the guide groove 7 again as shown in FIG. 9. To increase a width of the one end portion 7*a* of the guide groove 7 in a direction parallel to the axis line of rotation of the shuttle body 4, the second race member 3 it has a generally triangular recess 3*c* (a first recess) which is formed by removing a portion thereof which defines a portion of the substantially annular front surface 3*b* thereof which corresponds to the one end portion 7*a* of the guide groove 7. Thus, the width of the one end portion 7*a* of the guide groove 7 is greater, by a depth of the triangular recess 3*c*, than the width of a remaining portion of the guide groove 7. The triangular recess 3*c* is formed by additionally removing a portion of the contact surface 3*a* of the second race member 3. The recess 3*c* has a constant depth in the circumferential direction of the guide groove 7, and the constant depth of the recess 3*c* preferably falls in a range of about 1.0 mm to about 1.5 mm.

The shuttle body 4 supports a bobbin case (not shown) which accommodates a bobbin around which a bobbin thread is wound. A bobbin-thread guide plate 9 is detachably attached, with the help of a pair of screws 15, to an upper surface of the first race member 2 such that the guide plate 9 covers the respective upper surfaces of the first and second race members 2, 3. The guide plate 9 has a T-shaped groove 9*a*. The guide plate 9 separates the needle-thread loop 12*a* hooked and widened by the hook portion 4*a*, into a front portion which is passed in front of the shuttle body 4 and a rear portion which is passed in rear of the same 4.

Next, the operation of the oscillating shuttle constructed as described above will be described by reference to FIGS. 3 to 9. In FIGS. 4 to 9, the second race member 3 is not shown, i.e., is omitted, for more clearly showing the state in which the needle-thread loop 12*a* is bitten or jammed.

Figure 4:
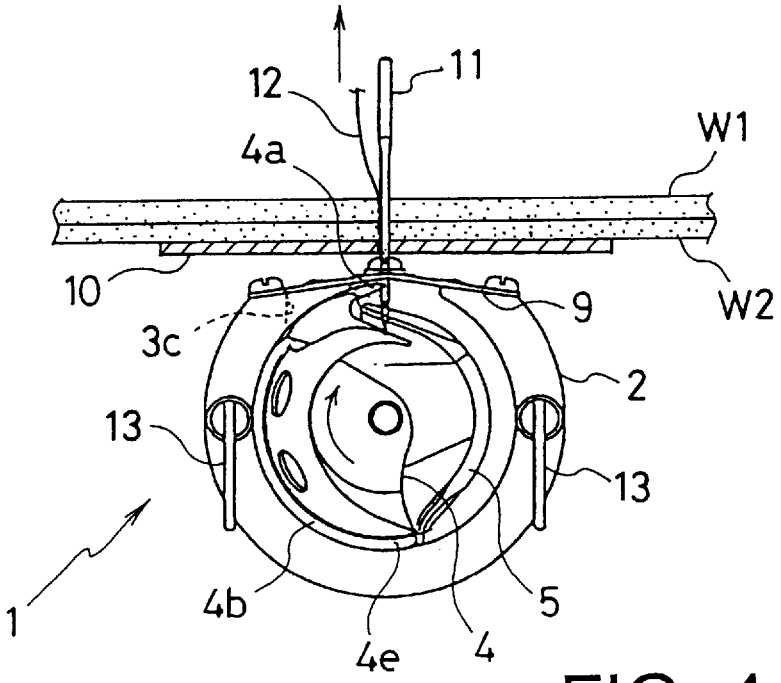
FIG. 4 is a front elevation view of the shuttle of FIG. 1 in a state in which a hook portion hooks or catches a needle thread.
Figure 5:
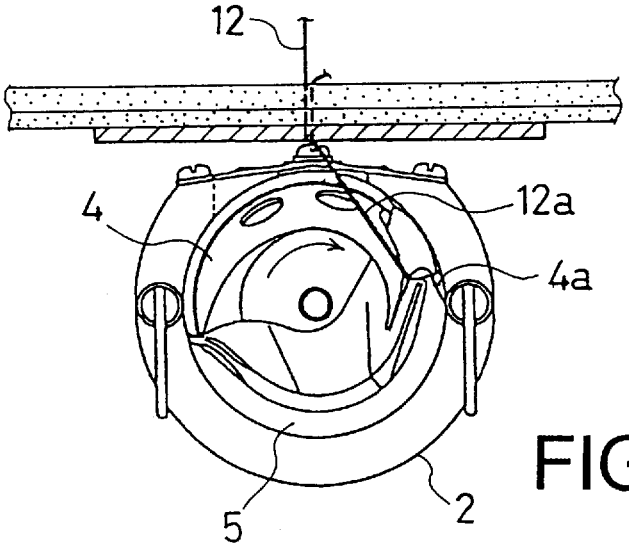
FIG. 5 is a view corresponding to FIG. 4, showing a state in which the hook portion forms a loop of the needle thread.

As shown in FIGS. 3 and 4, two thick denim sheets W1, W2 are placed in stack on a throat plate 10 having a needle throat (not shown). When the sewing machine including the present oscillating shuttle 1 performs bar-tack sewing on the work sheets W1, W2, first, the shuttle body 4 is rotated clockwise so that the hook portion 4*a* thereof hooks the loop 12*a* of the needle thread 12 conveyed by the eye of the sewing needle 11, as shown in FIG. 4, at a timing when the needle 11 is moved upward by a small distance after having taken its lowest position. Second, as shown in FIG. 5, as the shuttle body 4 is rotated clockwise, the needle-thread loop 12*a* is widened and is moved along the outer surfaces of the shuttle body 4. Then, as shown in FIG. 6, when a needle-thread take-up (not shown) takes its lowest position, the thread loop 12 is widened to a substantially maximum degree or level at which the loop 12*a* is about to slip from the hook portion 4*a*.

Next, as shown in FIG. 7, at a timing when the shuttle body 4 has been substantially half rotated clockwise and the thread loop 12*a* has already slipped from the hook portion 4*a*, the counterclockwise rotation of the shuttle body 4 commences and, as the needle-thread take-up is moved upward, the diameter of the thread loop 12*a* is decreased a because the needle thread 12 is drawn upward. Thus, the needle thread 12 is locked with the bobbin thread supplied from the bobbin supported by the shuttle body 4. Meanwhile, as shown in FIG. 8, since the thick denim sheets W1, W2 apply a great resistance to the needle thread 12 being moved upward, the needle-thread take-up may fail to draw up the needle thread 12, so that the thread loop 12*a* may fail to pass through the upper opening 8 before the tail portion 4*e* of the guided portion 4*b* of the shuttle body 4 enters the one end portion 7*a* of the guide groove 7. Thus, as shown in FIGS. 3 and 9, the lower end portion of the thread loop 12*a* may be caught by the tail portion 4*e* of the guided portion 4*b*.

Figure 2:
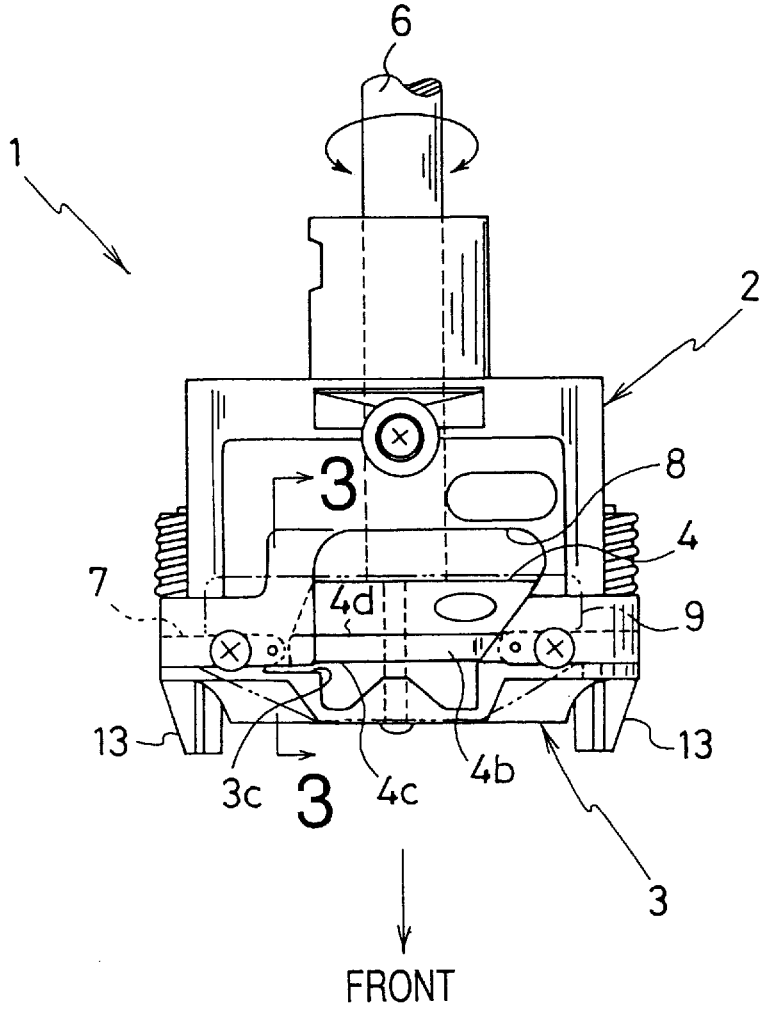
FIG. 2 is a plan view of the shuttle of FIG. 1.

Thus, as shown in FIG. 3, a front portion of the lower end portion of the thread loop 12*a* may enter a front space defined by a front surface 4*c* (FIG. 2) of the guided portion 4*b* and the rear surface 3*b* of the second race member 3, and a rear portion of the lower end portion of the thread loop 12*a* may enter a rear space defined by a rear surface 4*d* (FIG. 2) of the guided portion 4*b* and the front surface 2*a* of the first race member 2, respectively. Each of the front and rear spaces is very small, for accurately positioning the hook portion 4*a* relative to the sewing needle 11 in the direction parallel to the axis line of rotation of the shuttle body 4. However, the possibility that the rear portion of the lower end portion of the thread loop 12*a* may enter the rear space is much lower than the possibility that the front portion may enter the front space, owing to the provision of the guide plate 9. In addition, since the shuttle body 4 is supported by the driver 5 such that the body 4 is half-rotatable about the horizontal axis line, a sufficiently great space is provided between an outer circumferential surface of the guided portion 4*b* and the substantially cylindrical bottom surface 2*b* of the first race member 2. Moreover, in the present oscillating shuttle 1, the second race member 3 has the recess 3*c* to increase the width of the one end portion 7*a* of the guide groove 7. Thus, even if the lower end portion of the thread loop 12*a* may be caught by the tail portion 4*e* of the guided portion 4*b*, as shown in FIG. 3 or 9, the thread loop 12*a* is not bitten or jammed and is easily passed through the widened front space. Thus, the biting or jamming of the needle thread 12 is effectively prevented. Therefore, another recess (a second recess) similar to the recess 3*c* may be formed by removing a portion of the front annular surface 2*a* of the first race member 2 which defines the one end portion 7*a* of the guide groove 7.

While the present invention has been described in its preferred embodiment, it is to be understood that the present invention may be otherwise embodied.

For example, it is possible to omit either one of the first recess 3*c* and the second recess formed by removing the portion of the front surface 2*a* of the first race member 2 which defines the one end portion 7*a* of the guide groove 7. In addition, the triangular recess 3*c* may be replaced by a part-annular recess formed by removing only the portion of the annular front surface 3*b* of the second race member 3 which corresponds to the one end portion 7*a* of the guide groove 7 and not removing any other portion of the contact surface 3*a* of the second race member 3. Moreover, the tail portion 4*e* of the guided portion 4*b* may have a recess similar to the recess 3*c*, in either one, or each, of the pair of opposite surfaces 4*c* , 4*d*, so that the recessed tail portion 4*e* has a width smaller than that of a remaining portion of the guided portion 4*e*. In this case, either one, or both, of the recess 3*c* and the above-described second recess may be omitted. The recess 3*c* and/or the second recess may be replaced by an inclined surface or surfaces. In this case, the width of the one end portion 7*a* of the guide groove 7 increases in the clockwise direction toward the upper opening 8 in FIG. 9. Similarly, the recess or recesses formed in the tail portion 4*e* of the guided portion 4*b* may be replaced by an inclined surface or surfaces. In the last case, the width of the tail portion 4*e* decreases in the counterclockwise direction toward the end face thereof in FIG. 9.

It is to be understood that the present invention may be embodied with other changes, improvements, and modifications that may occur to those skilled in the art without departing from the scope and spirit of the invention defined in the appended claims.

What is claimed is:

1. An oscillating shuttle, comprising:

a first shuttle race member;

a second shuttle race member which is attached to the first shuttle race member and which cooperates with the first shuttle race member to provide a shuttle race having a substantially annular guide groove in an inner surface thereof, the shuttle race having an upper opening through which a sewing needle and a needle thread conveyed by the needle pass, the guide groove including two end portions which open in the upper opening such that the two end portions are opposed to each other in a circumferential direction of the guide groove;

a shuttle body which includes a part-annular guided portion and which is oscillatory while the part-annular guided portion is guided by the substantially annular guide groove, the shuttle body further including a hook portion which hooks a loop of the needle thread conveyed by the sewing needle, the part-annular guided portion including a tail portion which is opposite to the hook portion in the circumferential direction of the guide groove;

a driver which rotates the shuttle body about an axis line, wherein when the hook portion of the shuttle body hooks the thread loop, the shuttle body is rotated by the driver in one of opposite directions such that the tail portion of the part-annular guided portion passes through one of said two end portions of the substantially annular guide groove and enters the upper opening of the shuttle race and, when the shuttle body is rotated back in the other direction, the tail portion of the guided portion enters said one end portion of the guide groove; and at least one of (a) said one end portion of the guide groove having, in a direction parallel to the axis line, a width greater than a width of a remaining portion of the guide groove, and (b) said tail portion of the guided portion having, in a direction parallel to the axis line, a width smaller than a width of a remaining portion of the guided portion.

2. An oscillating shuttle according to claim 1, wherein said tail portion of the guided portion has a pair of opposite surfaces which are opposite to each other in the direction parallel to the axis line, and the first and second shuttle race members have respective opposed surfaces which are opposed to each other in the direction parallel to the axis line and cooperate with each other to define said one end portion of the guide groove, wherein a first distance between one of the opposite surfaces of said tail portion and a corresponding one of the respective opposed surfaces of the first and second shuttle race members is different from a second distance between the other surface of said tail portion and the other surface of said respective opposed surfaces.

3. An oscillating shuttle according to claim 2, wherein the second shuttle race member is detachably attachable to the first shuttle race member in the direction parallel to the axis line, and wherein the first distance between said one surface of said tail portion and said one surface of the first shuttle race member provided on the side of the driver is smaller than the second distance between the other surface of said tail portion and the other surface of the second shuttle race member.

4. An oscillating shuttle according to claim 1, comprising said one end portion of the guide groove which has, in the direction parallel to the axis line, a width greater than a width of the remaining portion of the guide groove.

5. An oscillating shuttle according to claim 4, wherein t he first shuttle race member has a substantially cylindrical surface and a substantially annular surface, and the second shuttle race member has a substantially annular surface which cooperates with the substantially cylindrical surface and the substantially annular surface of the first shuttle race member to define the substantially annular guide groove.

6. An oscillating shuttle according to claim 5, wherein the second shuttle race member has a recess in a portion thereof which defines a portion of the substantially annular surface thereof which corresponds to said one end portion of the guide groove, so that the width of said one end portion of the guide groove is greater, by a depth of the recess, than the width of the remaining portion of the guide groove.

7. An oscillating shuttle according to claim 6, wherein the depth of the recess of the second shuttle race member in the direction parallel to the axis line is constant in the circumferential direction of the guide groove.

8. An oscillating shuttle according to claim 7, wherein the constant depth of the recess of the second shuttle race member falls in a range of about 1.0 mm to about 1.5 mm.

9. An oscillating shuttle according to claim 1, further comprising an attaching device which detachably attaches the second shuttle race member to the first shuttle race member in the direction parallel to the axis line.

* * * * *